US009863388B2

(12) United States Patent
Rehwald et al.

(10) Patent No.: US 9,863,388 B2
(45) Date of Patent: Jan. 9, 2018

(54) HOLDING DEVICE FOR FASTENING A FUEL DISTRIBUTOR TO AN INTERNAL COMBUSTION ENGINE

(71) Applicant: Robert Bosch GmbH, Stuttgart (DE)

(72) Inventors: Andreas Rehwald, Bietigheim-Bissingen (DE); Marc Spinner, Sindelfingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 24 days.

(21) Appl. No.: 14/913,957

(22) PCT Filed: Jul. 3, 2014

(86) PCT No.: PCT/EP2014/064161
§ 371 (c)(1),
(2) Date: Feb. 23, 2016

(87) PCT Pub. No.: WO2015/032522
PCT Pub. Date: Mar. 12, 2015

(65) Prior Publication Data

US 2016/0208760 A1 Jul. 21, 2016

(30) Foreign Application Priority Data

Sep. 3, 2013 (DE) ..... 10 2013 217 538

(51) Int. Cl.
*F02B 67/00* (2006.01)
*F02M 69/46* (2006.01)
(Continued)

(52) U.S. Cl.
CPC ..... *F02M 69/465* (2013.01); *F02M 61/14* (2013.01); *F02B 63/04* (2013.01);
(Continued)

(58) Field of Classification Search
CPC ..... F02B 67/00; F02B 67/04; F02B 67/06; F02B 75/22; F02B 63/04; F02M 69/465; F02M 61/14
(Continued)

(56) References Cited

U.S. PATENT DOCUMENTS 5,168,842 A * 12/1992 Brooks ..... H01T 13/04 123/143 C
5,597,980 A * 1/1997 Weber ..... H02G 3/0418 123/143 C
(Continued)

FOREIGN PATENT DOCUMENTS

DE 10103825 8/2002
WO WO2005/025832 3/2005

OTHER PUBLICATIONS

International Search Report for PCT/EP2014/064161, dated Sep. 2, 2014.

*Primary Examiner* — Jacob Amick
*Assistant Examiner* — Charles Brauch
(74) *Attorney, Agent, or Firm* — Norton Rose Fulbright US LLP; Gerard Messina

(57) ABSTRACT

A holding device is used for fastening a fuel distributor to an internal combustion engine. A plurality of holding elements is provided, which are able to be fixed in place on the internal combustion engine via a fastener. A cable guide is provided in addition. The holding elements are connected to the cable guide. In addition, a system having such a holding device and a fuel distributor for conveying fuel are provided.

13 Claims, 5 Drawing Sheets

(51) Int. Cl.

| | |
|---|---|
| ***F02M 61/14*** | (2006.01) |
| *F02B 67/04* | (2006.01) |
| *F02B 63/04* | (2006.01) |
| *F02B 67/06* | (2006.01) |
| *F02B 75/22* | (2006.01) |

(52) U.S. Cl.
CPC ..... *F02B 67/00* (2013.01); *F02B 67/04* (2013.01); *F02B 67/06* (2013.01); *F02B 75/22* (2013.01); *F02M 2200/803* (2013.01); *F02M 2200/857* (2013.01)

(58) Field of Classification Search
USPC ..... 123/195 A
See application file for complete search history.

(56) References Cited

U.S. PATENT DOCUMENTS

| | | | | |
|---|---|---|---|---|
| 7,591,246 | B2 | 9/2009 | Beardmore et al. | |
| 2002/0046737 | A1 | 4/2002 | Lee et al. | |
| 2003/0070658 | A1* | 4/2003 | Warner | F02M 51/005 123/456 |
| 2006/0180539 | A1* | 8/2006 | Wolf | B01D 29/055 210/232 |
| 2011/0073074 | A1* | 3/2011 | Hay | F02M 55/025 123/456 |

* cited by examiner

HOLDING DEVICE FOR FASTENING A FUEL DISTRIBUTOR TO AN INTERNAL COMBUSTION ENGINE

FIELD

The present invention relates to a holding device for fastening a component, in particular a fuel distributor, to an internal combustion engine. In particular, the present invention relates to the field of fuel injection systems of internal combustion engines, where fuel under high pressure is injected into assigned combustion chambers of the internal combustion engine via fuel injection valves.

BACKGROUND INFORMATION

A fuel supply system having multiple holders is described in U.S. Pat. No. 7,591,246 B2. The individual holder has a first holder part and a second holder part, the two parts cooperating in such a way that they connect a fuel rail to a cylinder head in a reversible manner. A fastening screw which screws the holder parts to the cylinder head is provided for this purpose.

The fuel supply system described in U.S. Pat. No. 7,591,246 B2 may have the disadvantage that the space required for the wiring of the fuel injection valves is restricted by the holders. Furthermore, during the installation process, attention should be paid that the electrical wiring in the area of the holding devices will not be damaged.

SUMMARY

The example holding device according to the present invention and the example system according to the present invention may have the advantage of allowing a better development. In particular, the wiring of the fuel injection valves is able to be improved and reliable protection from damage can be ensured.

The holding device is preferably used for fastening a fuel distributor of a fuel injection system to a cylinder head of an internal combustion engine. However, the holding device may also be used for fastening some other component to the internal combustion engine. In addition, the attachment to the internal combustion engine may also be implemented indirectly, via one or more intermediate piece(s). Developments are possible in which one or more part(s) of the holding device is/are integral part(s) of the component, in particular to fuel distributor and the internal combustion engine, and/or in which a suitable counterpart for fixating, in particular screw-fitting, the fastening means is developed on the internal combustion engine, in particular a cylinder head.

The fuel distributor able to be fastened to the internal combustion engine via one or more holding element(s) is used as fuel accumulator when in operation. Pressure fluctuations in the fuel distributor and in fuel injectors connected to the fuel distributor cause pressure pulsations which may generate noise. To dampen such pressure pulsations, it is advantageous that the holding element has a first half shell and a second half shell; that at least one elastic rib is provided in a holding region of the first half shell and at least one elastic rib is provided in a holding region of the second half shell, the elastic rib provided in the holding region of the first half shell and the elastic rib provided in the holding region of the second half shell circumferentially enclosing a tubular base element of the fuel distributor. The elastic ribs may be produced from a viscoelastic material. Oscillations produced by pressure pulsations are therefore able to be damped in an effective manner.

Depending on the individual application case, the fuel distributor can be used for gasoline or diesel systems in the high or low pressure range and possibly be suitably adapted for this purpose. However, the fuel distributor may also be used for other fuels, in particular gaseous fuels. The component may furthermore also be used for other application cases, such as for conveying cooling water for power machines of hybrid vehicles.

It may be advantageous if multiple holding elements are provided, the holding elements are disposed on the cable guide at a distance from each other, and the holding elements are at least indirectly connected to the cable guide. This makes it possible to reliably secure the cable guide to the internal combustion engine. The cable guide and the fuel distributor are thereby also positioned in a reliable manner in relation to the internal combustion engine. The electrical lines can be routed to the individual fuel injectors or the like via the cable guide. A compact design then results in the installed state, which also makes it easier to install further attachment components. Reliable protection of the electrical lines from the environment is ensured in addition.

It may also be advantageous if the cable guide has a housing that includes an interior space, the housing is developed in such a way that electrical cables can be fed into an interior space of the housing when the housing is open, and the interior space is protected from the environment when the housing is closed. It may also be advantageous if the housing includes an insertion rail having a U-shaped profile and a cover, and that the cover is able to be connected to the insertion rail. The U-shaped profile is preferably connected to the at least one holding element. The electrical cables can then be placed in the insertion rail during the installation. This already results in the final position in relation to the outputs of the component, in particular cups of the fuel distributor. The cover may then be connected to the insertion rail by a snap-in connection, for example.

In one modified development, it may be advantageous if a housing part is provided on the at least one holding element which includes a guide profile part and a pivotable cover part. The electrical cables can then be placed in the guide profile part during the assembly. It may also be advantageous if the cover part is connected to the guide profile part via a foil hinge. This facilitates the assembly, since the position of the cover part on the guide profile part is already predefined by the construction. A loss prevention for the cover part is provided in addition.

Once the electrical cables have been placed in the guide profile part, the cover part can be connected to the guide profile part by a snap-in connection, for example, so that the cover part is fixed in place in a closed pivot position. It is also advantageous here that at least one insertion rail is provided and that one end of the insertion rail is fixed in place between the cover part and the guide profile part in the closed pivot position of the cover part of the housing part provided on the holding element. This makes it possible to ensure reliable protection of the electrical cables.

The holding device thus allows a function integration of an affixation on the internal combustion engine on the one hand, and a cable fixation, cable guidance and cable protection on the other. The holding device can be adapted to the geometrical design of the component, which may have a metallic design, and to the installation space available at the engine. Essential parts may be developed as injection-molded parts, so that an advantageous design variety results and a multitude of embodiments variants can be realized at low production expense. In particular, the fixation and guide can be implemented directly on the component, which also makes it easier to connect fuel injectors or similar devices. This enables in particular a precise installation of the signal and/or current supplies for a fuel distributor system. The connection of the electrical cables to the elements to be controlled, such as injectors, sensors, a fuel pump and control valves, and the connection of the interface, in particular a plug, is thereby able to be carried out with accurate positioning, so that reliable fastening is possible. The assembly may be carried out in in a flexible manner in accordance with the particular design. For example, a pre-assembled cable harness can be suitably fixed in position via the cable guide, in which case a preassembly within a fuel distributor system is possible. Another possibility consists of preassembling the cable guide on the fuel distributor system, the installation of the cable harness being undertaken only during the installation on the internal combustion engine. In this context further combinations and developments of the installation are conceivable as well.

BRIEF DESCRIPTION OF THE DRAWINGS

Preferred exemplary embodiments of the present invention are described in greater detail below with reference to the figures, in which corresponding elements have been provided with matching reference numerals.

DETAILED DESCRIPTION OF EXAMPLE EMBODIMENTS

Figure 1:
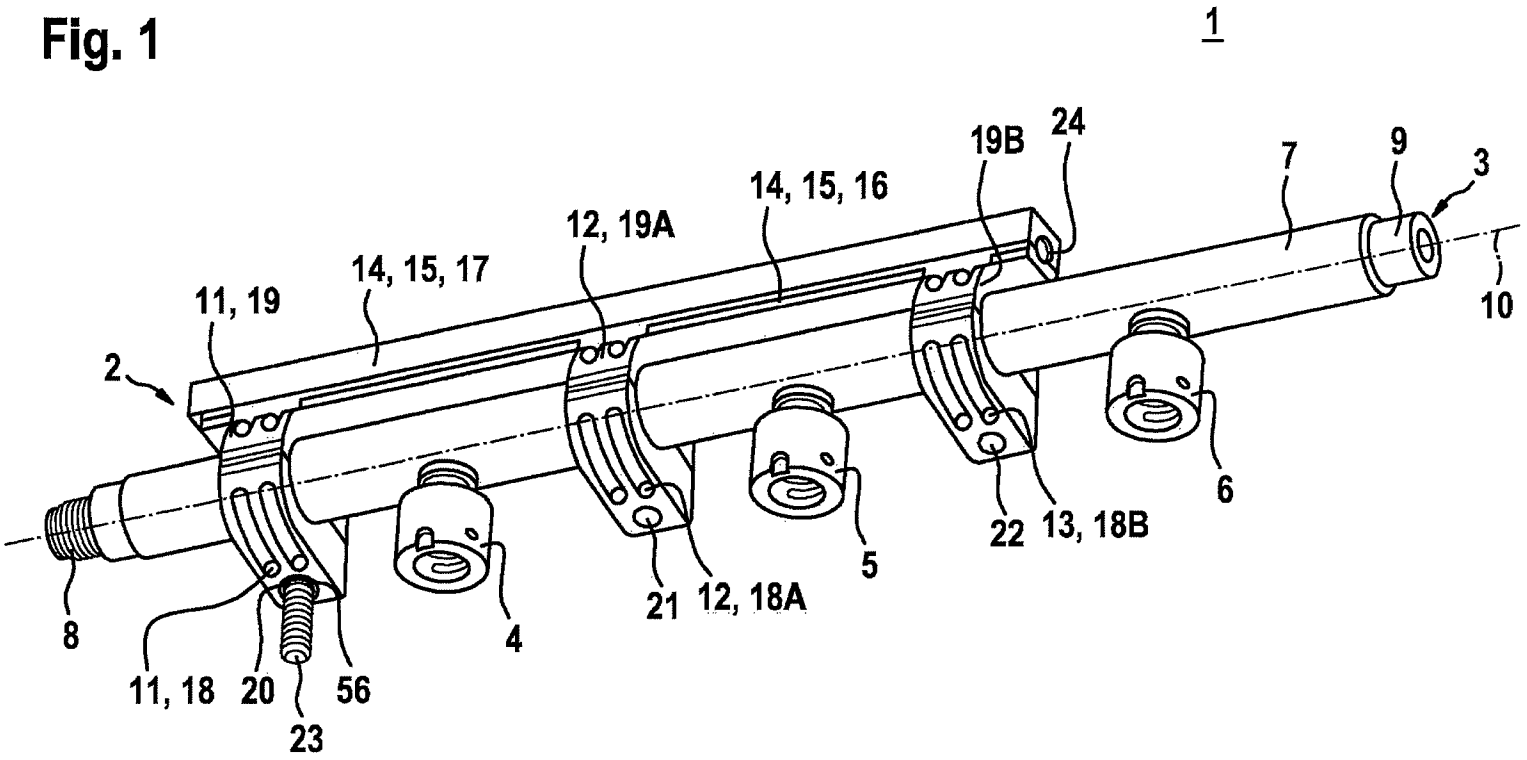
FIG. 1 shows a system having a holding device and a fuel distributor, in a three-dimensional representation that corresponds to a first exemplary embodiment of the present invention.

FIG. 1 shows a system 1 having a holding device 2 and a component 3 developed as fuel distributor 3, in a three-dimensional representation that corresponds to a first exemplary embodiment. In this exemplary embodiment, fuel distributor 3 is used for storing and distributing fuel to multiple fuel injectors, which are connected to fuel distributor 3 via cups 4, 5, 6 of fuel distributor 3. In this exemplary embodiment, fuel distributor 3 has a tubular base element 7. Holding device 2 is used in particular for fuel distributors 3 of this type. However, in one modified development component 3 may also be used for conveying other fluids. For example, component 3 may make it possible to conduct cooling water to be supplied to engines of hybrid vehicles.

Cups 4 through 6 are suitably connected to tubular base element 7. Furthermore, a connection thread 8 and an end piece 9 are provided on tubular base element 7. For example, a fuel line, which links fuel distributor 3 to a high-pressure pump, can be connected to connection thread 8. Depending on the development and application case, end piece 9 may possibly also be used for accommodating a sensor, especially a pressure sensor, and/or for connecting a pressure-limitation valve. In this particular exemplary embodiment, tubular base element 7 extends along a longitudinal axis 10. Cups 4 through 6 are disposed on tubular base element 7 at a distance from each other along longitudinal axis 10.

Holding device 2 includes holding elements 11, 12, 13 and a cable guide 14. Cable guide 14 has a housing 15, which includes an insertion rail 16 and a cover 17. Insertion rail 16 has a U-shaped profile. Cover 17 is placed on top of insertion rail 16 in the assembled state, as illustrated in FIG. 1. This connects cover 17 to insertion rail 16.

Holding element 11 has a first half shell 18 and a second half shell 19. Holding element 12 accordingly has a first half shell 18A and a second half shell 19A. In addition, holding element 13 has a first half shell 18B and a second half shell 19B.

Half shells 19, 19A, 19B are connected to insertion rail 16 of housing 15. A development in one piece, e.g., an injection-molded part, is possible, as well. Fastening bores 20, 21, 22 are provided on holding elements 11 through 13, which allow an attachment to the internal combustion engine. A fastener 23, developed as a screw 23, which extends through fastening bore 20 of holding element 11, is shown by way of example. Fastener 23 may be screwed into a suitable threaded bore of the internal combustion engine. This also connects half shells 18, 19 of holding element 11 to each other. Half shells 18, 19 of holding element 11 that enclose tubular base element 7 of fuel distributor 3 thereby fix tubular base element 7 in place on the internal combustion engine.

Housing 15 of cable guide 14 has suitable openings 24, 25 (FIG. 2) for routing electrical cables into and out of housing 15. Further openings may be provided in addition, which are formed at suitable locations in housing 15.

Figure 2:
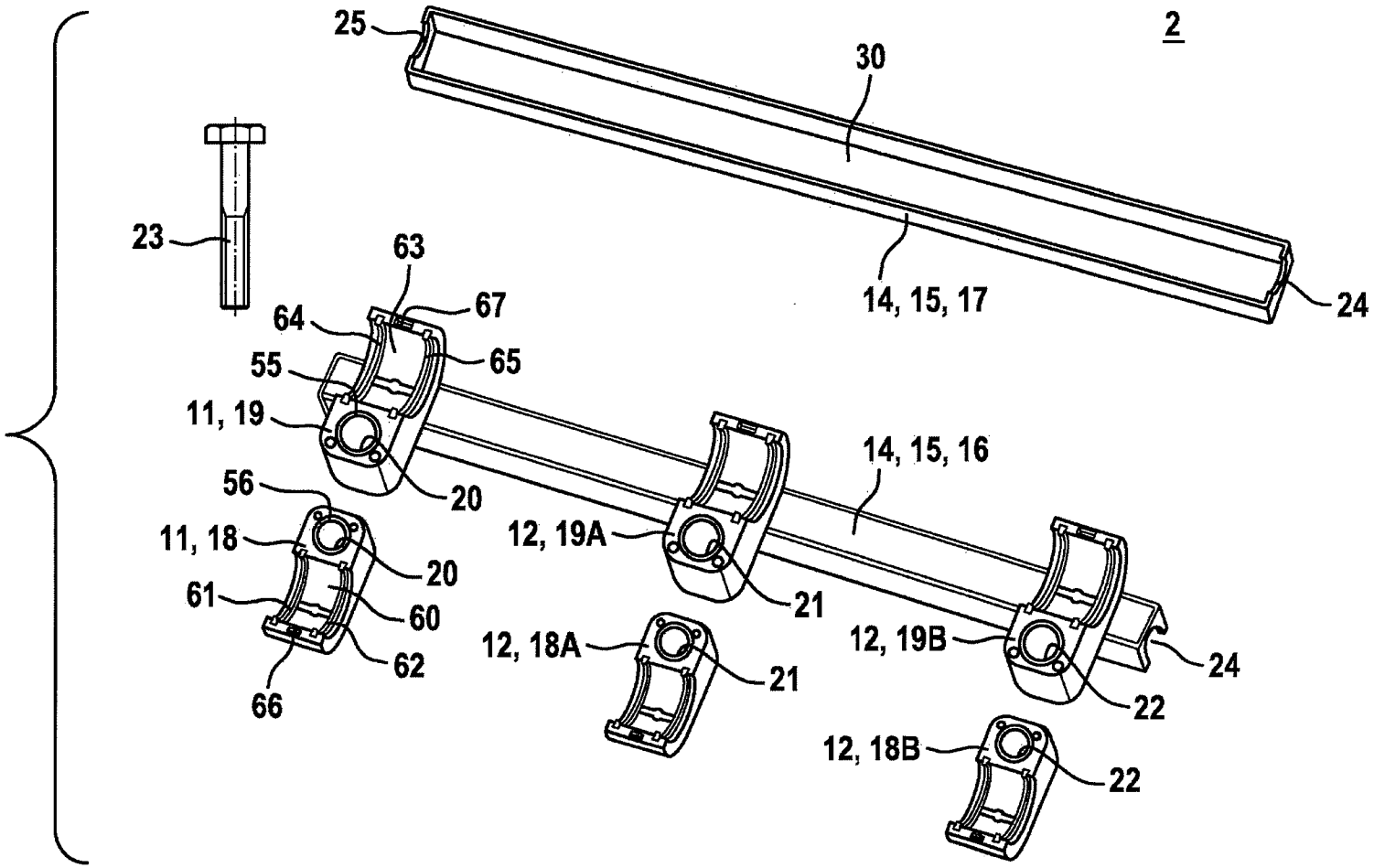
FIG. 2 shows the holding device of the system shown in FIG. 1 according to the first exemplary embodiment of the present invention, in a disassembled state prior to an assembly.

FIG. 2 shows holding device 2 of system 1 shown in FIG. 1, which corresponds to the first exemplary embodiment in the disassembled state prior to an assembly. Half shells 19, 19A, 19B are connected to insertion rail 16 of housing 15. Half shells 19, 19A, 19B are situated on housing 15 of cable guide 14, at a distance from each other. The positions of half shells 18, 18A, 18B in relation to insertion rail 16 are thereby specified as well. In the assembled state, holding elements 11 through 13 are then situated on cable guide 14 at a distance from each other, holding elements 11 through 13 being connected to cable guide 14. In this exemplary embodiment, a total of three fasteners, which are developed to correspond to fasteners 23, are required for screw-fitting holding device 2 to the cylinder head of the internal combustion engine, for example.

In the assembled state, an interior space 30 of housing 15 is formed between the insertion rail having the U-shaped profile and cover 17. Housing 15 is designed in such a way that in an open state of housing 15, electrical cables can be introduced into interior space 30 of housing 15, in particular placed there, and in a closed state of housing 15, interior space 30 is protected from the environment. This ensures mechanical protection of the cables introduced into interior space 30, among other things, while defined positioning in cable guide 14 is achieved in addition. This makes it easier to install further attachment components on the internal combustion engine or in the vicinity of the internal combustion engine. In this exemplary embodiment cover 17 is able to be plugged into insertion rail 16. A snap-in connection is possible as well. Cover 17 thus is able to be connected to insertion rail 16 in an advantageous manner, the connection possibly being developed as a releasable connection. In a correspondingly modified development, however, other connections and/or designs of cover 17 are possible as well.

Figure 3:
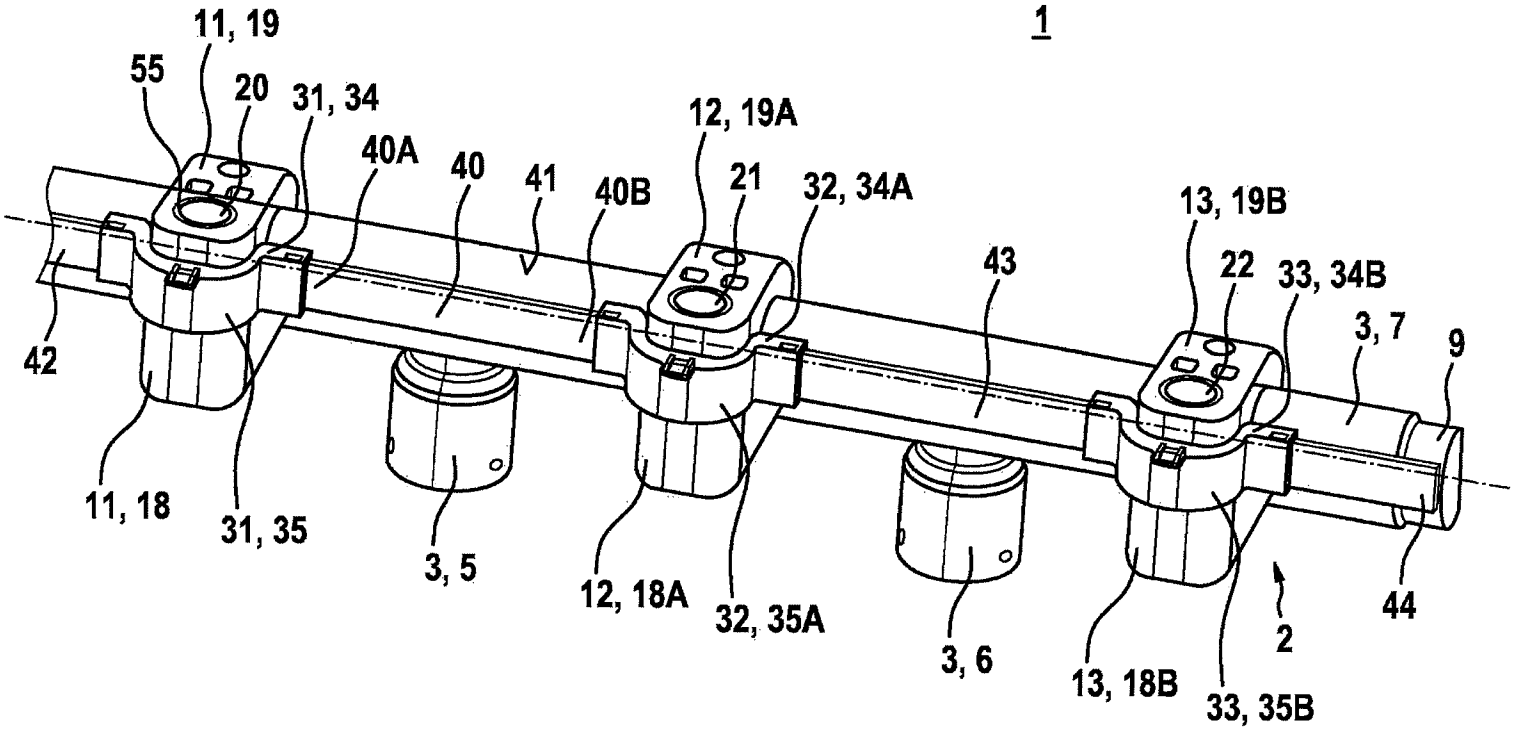
FIG. 3 shows a system having holding device and a fuel distributor in a three-dimensional representation that corresponds to a second exemplary embodiment of the present invention.

FIG. 3 shows a system 1 having a holding device 2 and a fuel distributor 3, in an excerpted three-dimensional representation corresponding to a second exemplary embodiment. In this exemplary embodiment housing parts 31, 32, 33 are provided on holding elements 11, 12, 13. Housing part 31 includes a holder-integrated guide profile part 34 and a pivotable cover part 35. In addition, housing part 32 includes a holder-integrated guide profile part 34B and a pivotable cover part 35A. Housing part 33 furthermore includes a holder-integrated guide profile part 34B and a pivotable cover part 35B. Each holder-integrated guide profile part 34, 34A, 35B is rigidly connected to associated half shell 19, 19A, 19B, but a development in one piece, in particular by injection molding, is possible as well. Pivotable cover parts 35, 35A, 35B, on the other hand, are able to pivot in relation to assigned half shells 19, 19A, 19B.

Housing parts 31, 32, 33 are shown in FIG. 3 in a closed pivot position of cover parts 35, 35A, 35B. In this closed pivot position, cover parts 35, 35A, 35B are closed by a snap-in connection with associated guide profile part 34, 34A, 34B.

An insertion rail 40 is situated between housing parts 31, 32. One end 40A of insertion rail 40 is fixed in place between cover part 35 and guide profile part 34. Another end 40B of insertion rail 40 is fixed in place between cover part 35A and guide profile part 34A. Insertion rail 40 may have a U-shaped profile. The electric cables are then enclosed between insertion rail 40 and an outer side 41 of tubular base element 7. However, other designs of insertion rail 40 are possible as well.

In addition, further insertion rails 42, 43, 44 are provided, which are installed in a corresponding manner.

Figure 4:
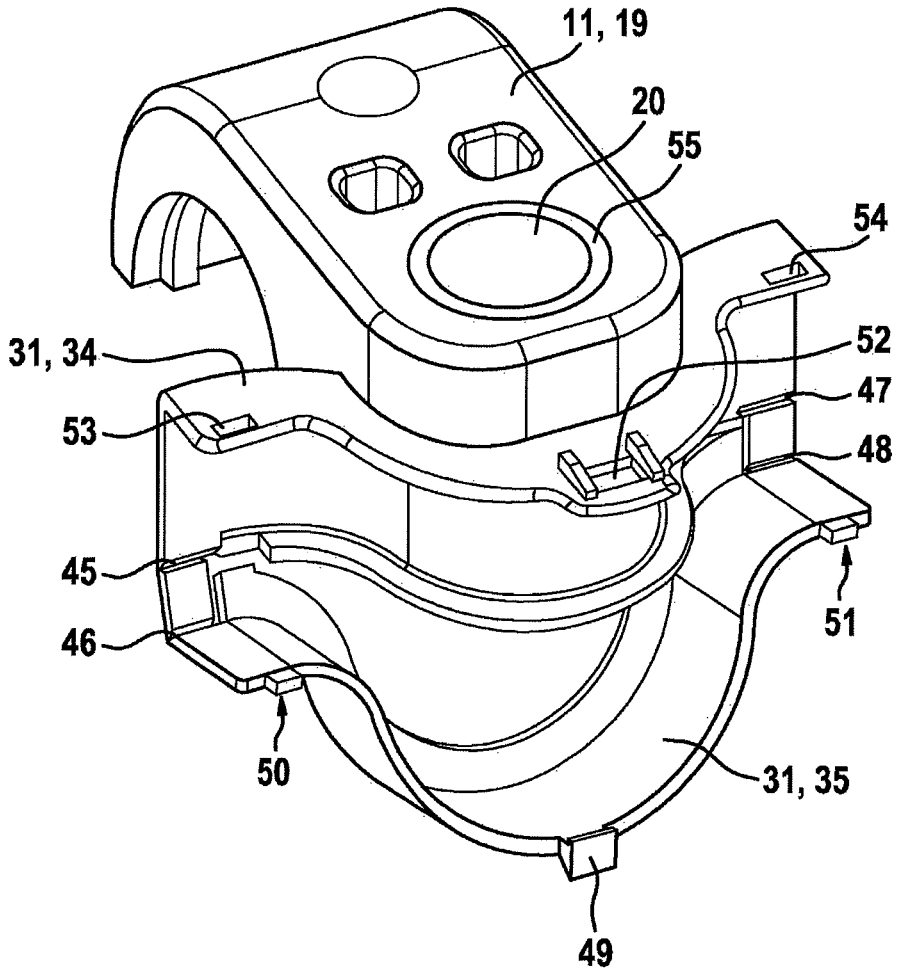
FIG. 4 shows an excerpted illustration of the holding device of the second exemplary embodiment shown in FIG. 3, in an open pivot position of a cover part.

FIG. 4 shows an excerpted illustration of holding device 2, shown in FIG. 3, of the second exemplary embodiment in an open pivot position of cover part 35. In this instance, cover part 35 is connected to guide profile part 34 via foil hinges 45, 46, 47, 48. For example, cover part 35 and guide profile part 34 may be formed jointly with half shell 19 by an injection-molded part. When cover part 35 is closed, detents 49, 50, 51 of cover part 35 engage with assigned depressions 52, 53, 54. This forms the snap-in connection between cover part 35 and guide profile part 34 in the closed pivot position illustrated in FIG. 3. Foil hinges 45 to 48 ensure the relative positioning, which simplifies the assembly. A loss prevention for pivotable cover part 35 is thereby provided in addition.

A metallic sleeve 55 may be inserted into half shell 19 in the region of fastening bore 20.

Figure 5:
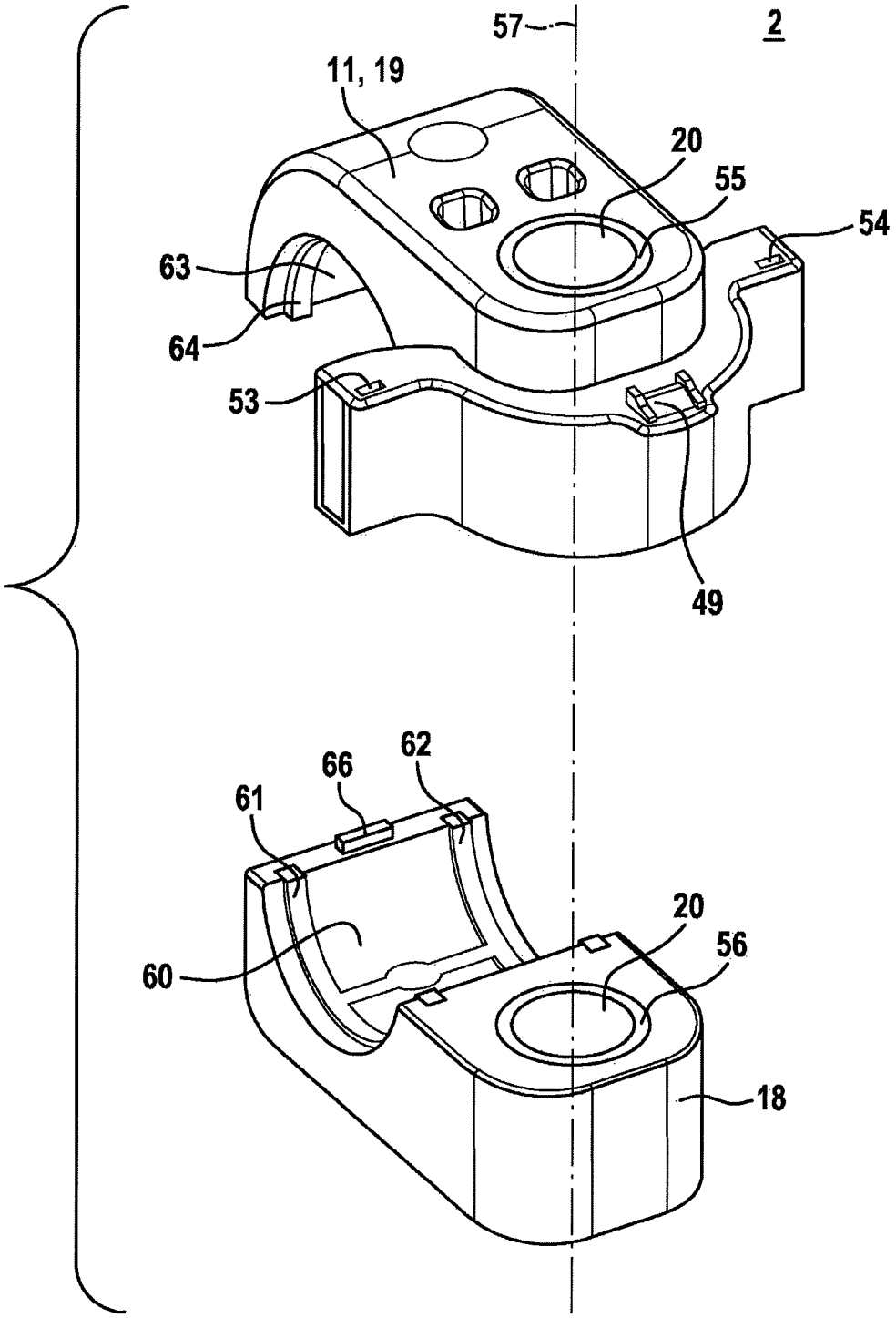
FIG. 5 shows an excerpted exploded view of the holding device of the second exemplary embodiment shown in FIG. 3, in a closed pivot position of a cover part.

FIG. 5 shows an excerpted explosive view of holding device 2, shown in FIG. 3, of the second exemplary embodiment in a closed pivot position of cover part 35. It is also possible to insert a metallic sleeve 56 into half shell 18 in the region of opening 20. The position of fastener 23 in relation to half shells 18, 19 is illustrated by an axis 57. In the assembled state, an elastic layer may be introduced into existing sleeves 55, 56 and an insulation of holding element 11 in relation to fastener 23 achieved in this manner, which enables vibration isolation, in particular. The transmission of structure-borne noise, among other things, is damped as a result.

Half shell 18 has a holding region 60, in which elastic ribs 61, 62 are provided. Elastic ribs 61, 62, for example, may be partially placed in corresponding depressions of holding region 60 of half shell 18. Accordingly, half shell 19 has a holding region 63 where elastic ribs 64, 65 are provided, as illustrated in a corresponding manner with the aid of FIG. 2, as well. Elastic ribs 64, 65, for example, may be partially placed in corresponding depressions of holding region 63 of half shell 19.

In this exemplary embodiment, a projection 66 is developed on half shell 18, which engages with a corresponding depression 67 of half shell 19 when the two half shells 18, 19 are joined. This improves the connection between half shells 18, 19 in the assembled state.

In the assembled state, half shells 18, 19 enclose outer side 41 of tubular base element 7 by their holding regions 60, 63. The direct contact is established via elastic ribs 61, 62, 64, 65. Elastic ribs 61, 62, 64, 65 thus ensure a certain isolation, in particular a vibration isolation, so that structure-borne noise is damped.

The development of holding elements 12, 13 corresponds to the development of holding element 11.

Similar to FIG. 3, FIG. 5 illustrates the engagement of detents 49, 50, 51 with depressions 52, 53, 54.

When adapted appropriately, component 3 may also be used for conveying other liquid or gaseous fluids. Holding device 2 then correspondingly ensures an attachment of component 3 to the internal combustion engine, in particular a cylinder head of the internal combustion engine.

The present invention is not restricted to the exemplary embodiments described.

What is claimed is:

1. A holding device for fastening a fuel distributor to an internal combustion engine, comprising:

at least one holding element which can be fixed in place on an internal combustion engine at least indirectly with the air of a fastener;

and a cable guide, the at least one holding element being at least connected to the cable guide;

wherein each of the at least one holding elements has a first half shell and a second half shell, wherein the first half shell and the second half shell are configured to connect to each other, and, configured to circumferentially enclose a tubular base element of a fuel distributor of the internal combustion engine when the first half shell and the second half shell are connected to each other;

wherein the at least one holding element includes multiple holding elements, each of the holding elements having a first half shell and a second half shell, wherein the first half shell and the second half shell are configured to connect to each other, and, configured to circumferentially enclose the tubular base element of the fuel distributor of the internal combustion engine when the first half shell and the second half shell are connected to each other, and wherein the holding elements are situated on the cable guide at a distance from each other, and the holding elements are at least indirectly connected to the cable guide.

2. The holding device as recited in claim 1, wherein the cable guide has a housing including an interior space, the housing being configured so that electrical cables can be introduced into the interior space of the housing when the housing is open, and wherein the interior space of the housing is protected from the environment when the housing is closed.

3. The holding device as recited in claim 2, wherein the housing has an insertion rail having a U-shaped profile, and a cover, the cover being configured to be connected to the insertion rail.

4. The holding device as recited in claim 3, wherein a housing part is provided on the at least one holding element, the housing part including a holder-integrated guide profile part and a pivotable cover part.

5. The holding device as recited in claim 4, wherein the cover part is able to be closed by a snap-in connection with the guide profile part in a closed pivot position.

6. The holding device as recited in claim 5, wherein the cover part is connected to the guide profile part via at least one foil hinge.

7. The holding device as recited in claim 5, wherein at least one insertion rail is provided, one end of the insertion rail being fixed in place between the cover part and the guide profile part in the closed pivot position of the cover part of the housing part provided on the holding element.

8. A system for having a holding device, the holding device including:

at least one holding element which can be fixed in place on an internal combustion engine at least indirectly with the air of a fastener;

a cable guide, the at least one holding element being at least indirectly connected to the cable guide; and a component which is used for conveying a fluid;

wherein each of the at least one holding elements has a first half shell and a second half shell, wherein the first half shell and the second half shell are configured to connect to each other, and, configured to circumferentially enclose a tubular base element of the component when the first half shell and the second half shell are connected to each other;

wherein the at least one holding element includes multiple holding elements, each of the holding elements having a first half shell and a second half shell, wherein the first half shell and the second half shell are configured to connect to each other, and, configured to circumferentially enclose the tubular base element of the component when the first half shell and the second half shell are connected to each other, and wherein the holding elements are situated on the cable guide at a distance from each other, and the holding elements are at least indirectly connected to the cable guide.

9. The system as recited in claim 8, wherein at least one elastic rib is provided on a holding region of the first half shell, at least one elastic rib is provided on a holding region of the second half shell, and the at least one elastic rib provided on the holding region of the first half shell, the at least one elastic rib provided on the holding region of the first half shell and the at least one elastic rib provided on the holding region of the second half shell are configured to directly contact the tubular base element of the component.

10. The holding device as recited in claim 1, wherein each of the holding elements includes a bore for receiving a fastener therethrough, the fastener for connecting the cable guide and the fuel distributor to the internal combustion engine, and for connecting the first half shell and the second half shell together.

11. The holding device as recited in claim 1, wherein the tubular base element extends in a direction parallel to the cable guide.

12. The system as recited in claim 8, wherein each of the holding elements includes a bore for receiving a fastener therethrough, the fastener for connecting the first half shell and the second half shell to each other.

13. The system as recited in claim 8, wherein the component is a fuel distributor, and wherein each of the holding elements includes a bore for receiving a fastener therethrough, the fastener connecting the cable guide and the fuel distributor to an internal combustion engine, and connecting the first half shell and the second half shell to each other.

* * * * *